US006443342B1

(12) United States Patent
Kahn

(10) Patent No.: US 6,443,342 B1
(45) **Date of Patent: *Sep. 3, 2002**

(54) TOOL BELT DOUBLE TOOL TOTE

(76) Inventor: Peter P. Kahn, 381 S. Country Rd., Brookhaven Hamlet, NY (US) 11719

( * ) Notice: Subject to any disclaimer, the term of this patent is extended or adjusted under 35 U.S.C. 154(b) by 0 days.

This patent is subject to a terminal disclaimer.

(21) Appl. No.: 09/783,212

(22) Filed: Feb. 15, 2001

(51) Int. Cl.[7] ..... A45F 5/00
(52) U.S. Cl. ..... 224/268; 224/269; 224/904
(58) Field of Search ..... 224/197, 268, 224/269, 272, 904

(56) References Cited

U.S. PATENT DOCUMENTS 1,270,158 A * 6/1918 Hill ..... 224/666
3,022,898 A * 2/1962 Loeb ..... 211/64
4,962,873 A * 10/1990 Schattel ..... 224/268
D315,447 S * 3/1991 McMahon ..... D3/224
5,743,451 A * 4/1998 Kahn ..... 224/268
5,943,696 A * 8/1999 Walker ..... 2/51
6,062,449 A * 5/2000 Kahn ..... 224/268
D443,135 S * 6/2001 Marks et al. ..... D3/228
6,325,577 B1 * 12/2001 Anderson ..... 206/350

* cited by examiner

*Primary Examiner*—Stephen K. Cronin
(74) *Attorney, Agent, or Firm*—Peter A. Borsari

(57) ABSTRACT

A tool belt tool tote device that is capable of carrying two tools independently, such as a cordless drill and a hammer. The double tool tote device comprises a C-shaped clip, a terminal swivel element and two hook elements. In use, a tool depending from each hook may freely swivel to maintain its center of gravity so that the tool will remain securely attached to the tool tote while remaining easily accessible to the user. In addition, each hook element is rotatably positionable to permit the user to independently position each tool in a comfortable fashion. The two hook elements also can be selectively positioned to retain one tool element across the breadth of the two hook elements.

16 Claims, 3 Drawing Sheets

TOOL BELT DOUBLE TOOL TOTE

FIELD OF INVENTION

The present invention relates to the field of carrying or toting devices, and more particularly to a tool belt attachment that is capable of carrying two tools independently, such as a cordless drill and a pneumatic nail gun. The double tool tote device of the present invention is an improvement of the inventor's "Tool Belt Tool Tote" described in U.S. Pat. No. 5,743,451 issued and U.S. Pat. No. 6,062,449, issued May 16, 2000. The inventive double tool tote device comprises a C-shaped clip, a swivel element and two hook members. In use, a tool depending from each hook may freely swivel to maintain its center of gravity so that the tool will remain securely attached to the tool tote while remaining easily accessible to the user.

BACKGROUND OF THE INVENTION

Tool belts of various designs have been described in the prior art in order to carry and retain one or more desired tools while allowing the user to keep his hands free. The conventional tool belts are provided with leather or cloth loops which depend from the belt and which serve as tool retainers. Although useful to some extent, such tool belts present inherent deficiencies which limit their usefulness. For example because cloth is not necessarily a rigid structure, cloth loops may close when not in use, making it difficult for the user to replace the tool into the loop with one hand. More over, a loop may tightly constrict about the tool handle as the tool settles into position, thereby making it difficult to remove the tool when needed. Similar problems arise with the use of the more rigid leather loops. A more significant problem with the common tool belt is that the tool or tools being retained therein remain in a fairly static position with respect to the retaining loops. In other words, the tool fails to swivel as the user moves about to maintain its center of gravity. This limitation can create a dangerous situation as the user wearing a tool belt carrying multiple tools moves about due to the fact that one or more of the tools may slip out of its loop, for example when the user is climbing, thereby endangering personnel and materials located below. Moreover, conventional tool belts are designed to hold shafted objects, such as hammers, screwdrivers and the like, and are ill-suited for holding and retaining non-shafted tools, such as a power drill. When a user requires both a non-shafted tool and another tool, he often must hand carry the non-shafted tool, which can present problems when the user must climb a ladder or needs the use of both his hands. In addition, conventional tool belts are not designed for carrying heavier tools, such as a cordless drill, screw guns, and/or pneumatic and gas driven nail guns.

Despite the teachings of the prior art, a need still exists for a tool toting device which may be attached to a belt or tool-belt that facilitates carrying of at least one non-shafted tool, such as a power drill, and at least one other tool in a safe and convenient manner which frees the user's hands. Such a device should be sufficiently rigid so that the user can store both types of tools onto it with one hand and retrieve each tool with the use of one hand. Such a device also should permit swiveling of the carried tools such that each tool's center of gravity may not be shifted to a dangerous position, but rather maintains the tool within the safe control of the user even while climbing about in a work space.

SUMMARY OF THE INVENTION

Accordingly, it is an object of the present invention to provide a double tool tote device in which the aforementioned problems can be overcome comprising a clip affixed to a belt from which depends two independently swivelable hooks each capable of retaining a desired tool.

It is a further object of the present invention to provide a double tool tote device which is capable of retaining two tools, each of which can be removed independently with one hand.

It is another object of the present invention to provide a double tool tote device which permits the user to adjust the position of each retained tool to a position which is comfortable and easily accessible from both the left-hand and right-hand side of the workman.

It is yet another object of the present invention to provide a double tool tote device which is capable of carrying a non-shafted tool, such as a power tool.

It is still another object of the present invention to provide a double tool tote device which is economical to manufacture, durable in construction and effective in operation.

Additional objects, advantages and novel features of the present invention will be set forth in part in the description which follows and in part will become apparent to those skilled in the art upon examination of the following specification or may be learned by practice of the invention. To the accomplishment of the above-related objects, this invention may be embodied in the forms illustrated in the accompanying drawings, attention being called to the fact, however, that the drawings merely are illustrative, and that changes may be made in the specific construction illustrated and described within the scope of the appended claims.

BRIEF DESCRIPTION OF THE DRAWINGS

The present invention will be better understood with reference to the appended drawing sheets, wherein:

FIG. 3A is a bottom view of the cap lock shown in FIG. 3.

DETAILED DESCRIPTION

Figure 1:
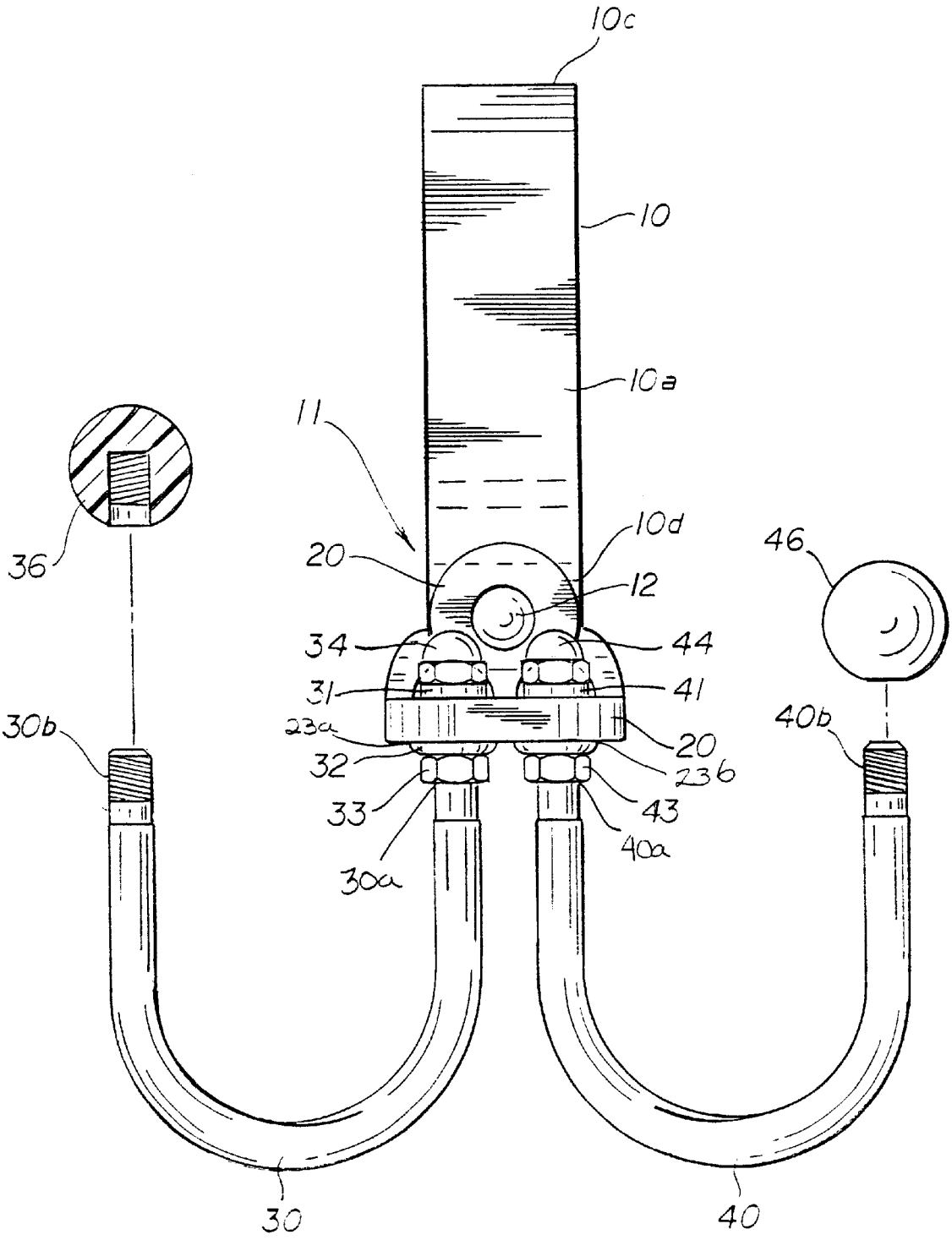
FIG. 1 is a front view of the double tool tote of the present invention.

The present invention relates to a device for supporting and carrying a variety of tools on a belt, and in particular on a standard tool-belt. Referring to the figures, the device comprises a clip 10, a swivel element 20 and a first U-shaped hook member 30 and a second U-shaped hook member 40. Clip 10 is in the form of a C-shaped clip having a front face 10*a*, a rear face 10*b* and a rounded top end 10*c*; the front face 10*a* terminating into a connecting end 10*d* having an aperture 11 disposed therein. Swivel element 20 comprises a first end 20*a* and a second end 20*b*. First end 20*a* is provided with an aperture 21 corresponding in size to aperture 11 such that the apertures can be aligned and joined by introducing a suitable fastening means 12 through said apertures 11 and 21. Suitable fastening means include, for example, the use of a semi-tubular rivet of sufficient diameter to be inserted through apertures 11 and 21, a conventional bolt and nut arrangement or providing internally threaded apertures which can be connected by an externally threaded bolt. Preferably, the fastening means is a simple semi-tubular rivet 12 having a diameter slightly less than the diameter of apertures 11 and 21, thereby providing the swivel element 20 with a rotation of about 180° to about 360° about the axis of the rivet. The second end 20*b* of swivel element 20 has a top surface 22*a*, a bottom surface 22*b* and is provided with a pair of apertures 23*a* and 23*b* for engaging and attaching U-shaped hooks 30 and 40 respectively thereto.

Figure 2:
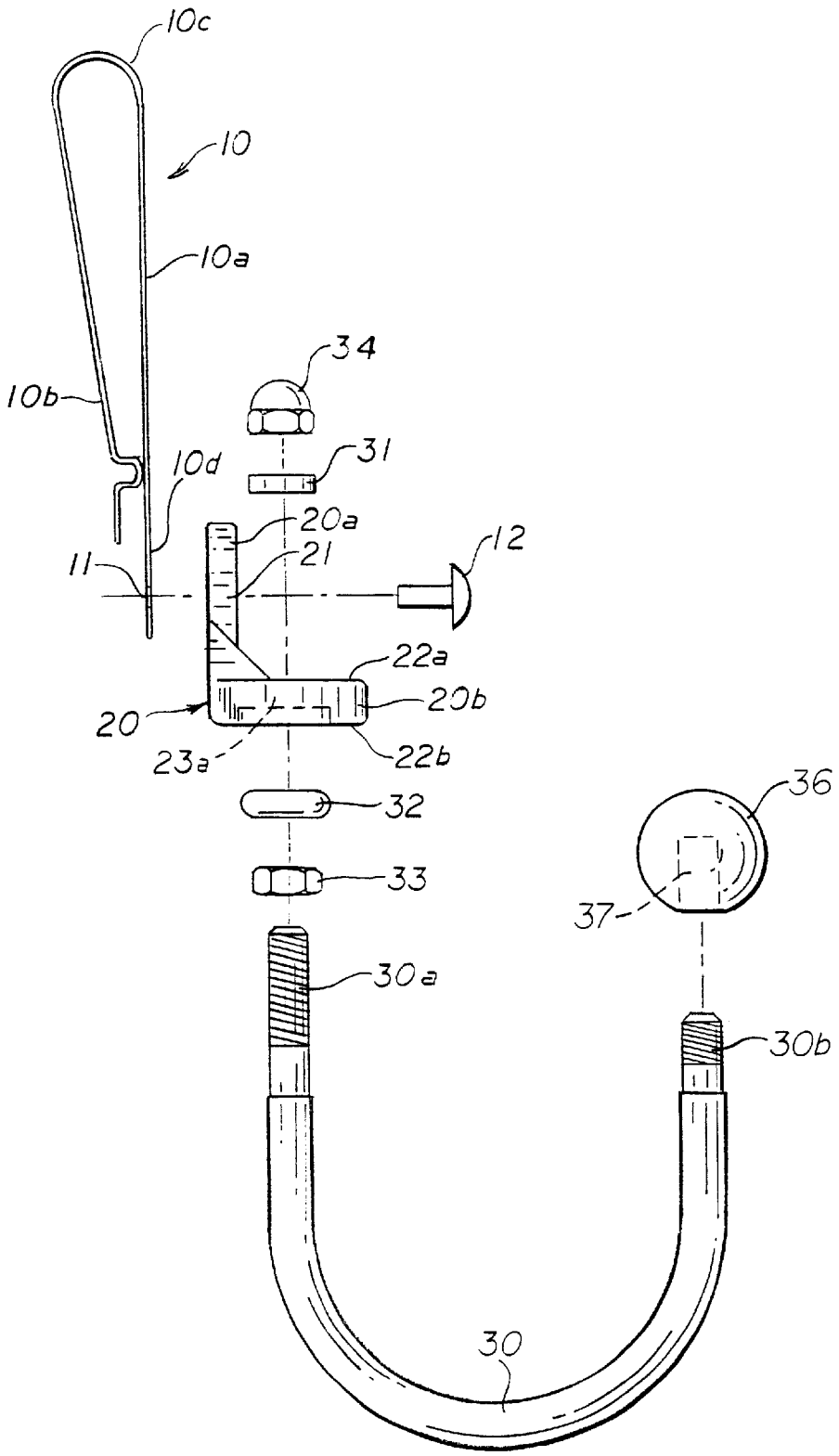
FIG. 2 is an exploded side view of the double tool tote of the present invention, showing one of the hook members.

Referring to FIGS. 1 and 2, U-shaped hook 30 comprises a first externally threaded end 30*a* and a second distal end 30*b*. The coupling means to securely attach the U-shaped hook 30 to the swivel element 20 comprise an O-ring 32, an O-ring or nylon washer 31, an internally threaded jam nut 33 and an acorn nut 34. To join the U-shaped hook 30 to the swivel element 20, jam nut 33 threadedly engages first end 30*a* of hook 30, the O-ring 31 is disposed onto the jam nut and the first end 30*a* is introduced into the aperture 23*a* such that the first end 30*a* extends through the top surface 22*a* of the swivel element 20. The nylon washer is disposed over the first end and a locking acorn nut 34 is used to threadedly engage the first end. Similarly, U-shaped hook 40 comprises a first externally threaded end 40*a* and a second distal end 40*b*. The coupling means to securely attach the U-shaped hook 40 to the swivel element 20 comprise an O-ring 42, an O-ring or nylon washer 41, an internally threaded jam nut 43 and an acorn nut 44. To join the U-shaped hook 40 to the swivel element 20, jam nut 43 threadedly engages first end 40*a* of hook 40, the O-ring 41 is disposed onto the jam nut and the first end 40*a* is introduced into the aperture 23*b* such that the first end 40*a* extends through the top surface 22*a* of the swivel element 20. The nylon washer is disposed over the first end and a locking acorn nut 44 is used to threadedly engage the first end.

Preferably, glue or similar adhesive is applied to the interior surface of jam nuts 33 and 43 such that each nut is permanently affixed to the lower portion of the respective threaded first end 30*a* and 40*a*. Alternatively, the jam nuts are provided with a nylon washer or similar element in order to provide a stronger engagement with the first threaded ends. In this manner, the hook members 30 and 40 are securely attached to the swivel element, but each is capable of rotating about its axis without become loose due to the frictional nature of the O-ring and nylon washer arrangement, thereby allowing the hook to be positioned for comfort. Preferably, each hook member is composed of a soft aluminum metal or alloy thereof such that it is flexible and will bend under minimum pressure but is capable of being re-bent to its original shape. Capping means in the form of a ball, knob or similar device 36, 46 may be inserted over the second end 30*b*, 40*b*of the respective hook members 30 and 40. The incorporation of the ball protects the user from contacting the second end of the hook member with his hand and prevents undue wear to the device. Preferably, the second end 30*b*, 40*b*is knurled and the ball 36, 46 is provided with a recess 37, 47 such that the ball can be pressed onto the second end of the hook member. Alternatively, the second end of the hook may be externally threaded and the recess is provided with internally mating threads such that the ball may be readily screwed onto the second end of the hook member.

Figure 3:
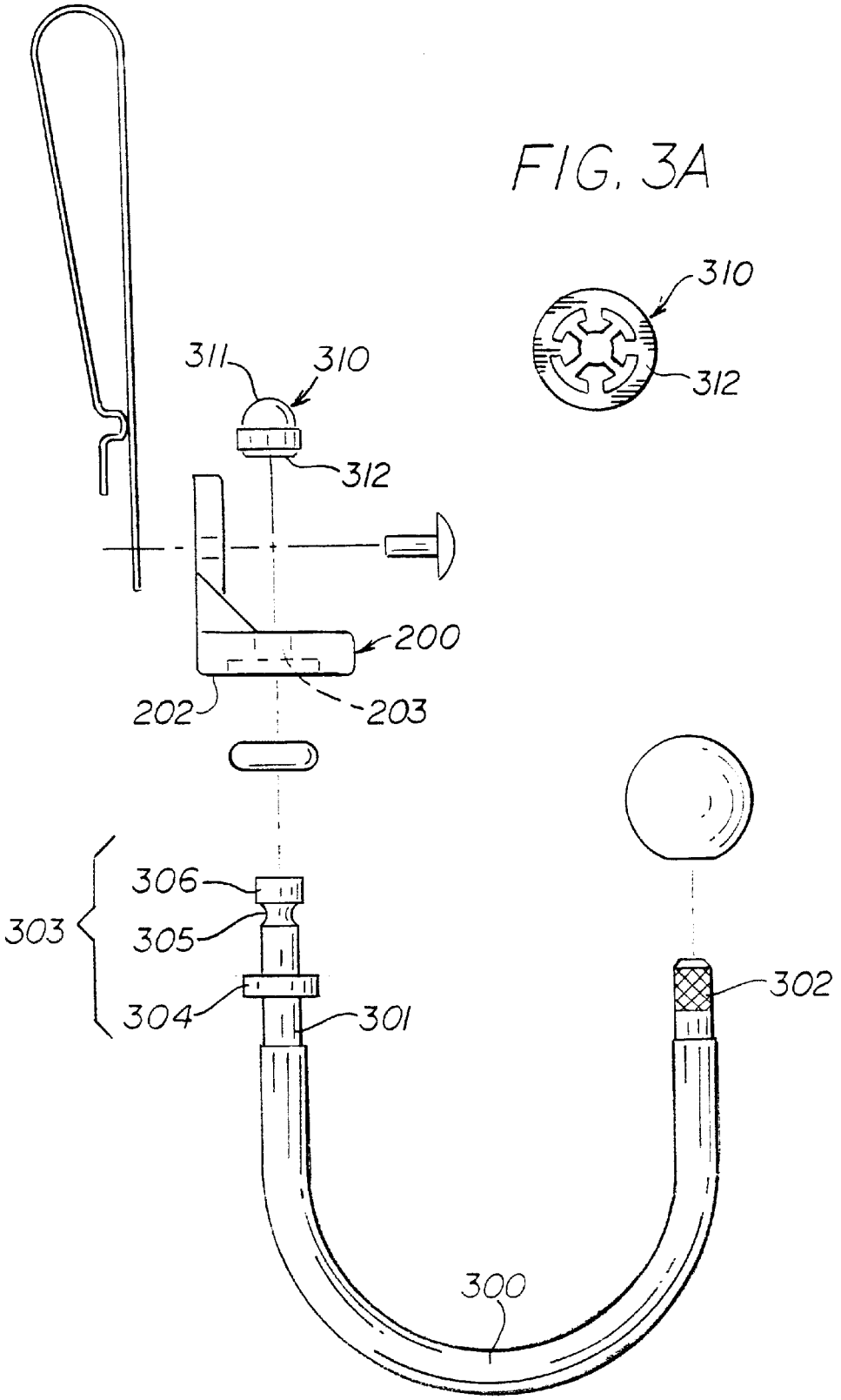
FIG. 3 is an exploded side view of the double tool tote of the present invention showing an alternate hook member.

FIGS. 3 and 3A show an alternate embodiment of securing the hook members to the swivel element. Referring to FIGS. 3 and 3A, U-shaped hook 300 comprises a first end 301 and a second distal end 302. First end 301 is provided with a locking element 303 comprising a circumferential flange 304, a conical mid-section 305 tapering toward the first end and a terminal locking knob 306. In this embodiment, the swivel element 200 is provided with a slightly elongated aperture 203. A cap lock 310, having a top surface 311 and a bottom surface 312 which is configured in such a manner that it can engage and be securely fastened onto the terminal locking knob 306. To join the U-shaped hook 300 to the swivel element 200, the first end 301 is introduced into aperture 203 such that the terminal locking knob 306 extends through the aperture and the flange 304 contacts the bottom surface 202 of the swivel element 200. The bottom surface 312 of the cap lock 310 engages the terminal locking knob 306 such that locking knob is firmly secured thereto. Optionally, cap lock 310 can be designed such that it is detachably secured to the locking knob 306. It is to be understood that although only one hook member is described, both hook members can be joined to the swivel element in this manner.

The clip 10 can be fastened to a belt, tool belt, tool holster or any other conventional means for carrying tools, simply by inserting the belt, tool belt etc. into the space between the front face 10*a* and the rear face 10*b* such that the front face faces outwardly. The clip 10 may be composed of any suitable material conventional to the art, including, for example, hard or soft metals or metal alloys, hard plastics, flexible plastics and combinations thereof, for example, a metal clip having an outer plastic covering. A variety of tools can be hung from each of the hook members 30 and 40; once a tool is suspended from one of the hook members, the hook member automatically adjusts for the tool's center of gravity by the swivelling action of the swivel element 20 about the axis of hook member. In this manner, the tool not only is prevented from falling off of the hook, but also is readily accessible to the tool belt wearer. The tool belt wearer is able to re-position a tool supported by one of the hook members 30, 40 simply by rotating the respective hook along the longitudinal axis of its first end. Alternatively, both hook members can be swiveled either toward or away from one another such that both can be used to hold a desired tool, such as by laying the tool within the U-shaped portions of both hook members.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A tool-belt tool tote device comprising:

a clip including a front face and a rear face, said front face terminating into connecting end having a first aperture disposed therein;

a swivel element including a first end having a second aperture disposed therein corresponding in size to said first aperture and a second end having a top surface, a bottom surface, a first opening and a second opening;

a first hook element and a second hook element, each of said first and second hook elements having a first end and a distal second end;

a first fastening means to securely and swivelably attach said swivel element to said clip;

a second fastening means to rotatably attach said first hook element to said swivel element through said first opening, and a third fastening means to rotatably attach said second hook element to said swivel element through said second opening.

2. The tool belt tote device in accordance with claim 1, wherein said first fastening means comprises a semi-tubular rivet introduced through said first and second apertures.

3. The tool belt tote device in accordance with claim 1, wherein said first end of each of said first and second hook elements is externally threaded.

4. The tool belt tote device in accordance with claim 3, wherein at least one of said second and third fastening means comprises an acorn nut and a jam nut, said acorn nut and said jam nut both capable of engaging said externally threaded first end of one of said first and second hook elements.

5. The tool belt tote device in accordance with claim 4, wherein each of said said second and third fastening means comprises an acorn nut and a jam nut, said acorn nut and said jam nut both capable of engaging said externally threaded first end of one of said first and second hook elements.

6. The tool belt tool tote device in accordance with claim 5, wherein each of said first and second hook elements is rotatably attached to said swivel element by threadedly engaging a jam nut to each of said first ends of said first and second hook elements, introducing each of said first ends of said first and second hook elements into said first and second openings respectively of said swivel element such that said first end of each of said first and second hook elements extends through said top surface of said swivel element and is retained through said top surface by an acorn nut.

7. The tool belt tool tote device in accordance with claim 6, wherein each of said second and third fastening means further comprises an O-ring disposed between said jam nut and said swivel element and an O-ring disposed between said acorn nut and said swivel element.

8. The tool belt tool tote device in accordance with claim 1, wherein said second distal end of at least one of said first and second hook elements is externally threaded and further comprising capping means having an internally threaded recess which is capable of engaging said distal second end.

9. The tool belt tool tote device in accordance with claim 1, wherein said second distal end of at least one of said first and second hook elements is knurled and further comprising capping means having an internal recess which is capable of engaging said knurled second end.

10. The tool belt tool tote device in accordance with claim 1, wherein said first and second hook elements are fabricated from hard or soft metals, metal alloys, hard plastics, flexible plastics or combinations thereof.

11. The tool belt tool tote device in accordance with claim 1, wherein said clip is fabricated from hard or soft metals or metal alloys, hard plastics, flexible plastics or combinations thereof.

12. The tool belt tool tote device in accordance with claim 1, wherein said first end of at least one of said first and second and hook elements comprises a locking element capable of engaging one of said first and second openings of said swivel element.

13. The tool belt tool tote device in accordance with claim 12, further comprising at least one cap lock, said cap lock having a top surface and a bottom surface configured to engage and detachably fasten onto said locking element.

14. The tool belt tool tote device in accordance with claim 12, wherein said locking element has a circumferential flange, a conical mid section tapering toward said first end and a terminal locking knob.

15. The tool belt tool tote device in accordance with claim 14, further comprising at least one cap lock, said cap lock having a top surface and a bottom surface configured to engage and detachably fasten onto said terminal locking knob.

16. The tool belt tool tote device in accordance with claim 15, wherein each of said first and second hook elements is rotatably attached to said swivel element by introducing each of said first ends of said first and second hook elements through said first and second openings respectively, in such a manner that said conical mid portion and terminal locking knob of each of said first and second hook elements extend through said top surface of said swivel element and said circumferential flange of each of said first and second hook elements contacts said bottom surface of said swivel element, and retaining each of said extended first ends through said top surface by said cap lock.

* * * * *